US011434557B2

(12) United States Patent
Lee

(10) Patent No.: US 11,434,557 B2
(45) Date of Patent: Sep. 6, 2022

(54) LOW-TEMPERATURE STEEL PLATE HAVING EXCELLENT IMPACT TOUGHNESS, AND METHOD FOR MANUFACTURING SAME

(71) Applicant: POSCO, Pohang-si (KR)

(72) Inventor: Hak-Cheol Lee, Pohang-si (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 16/763,861

(22) PCT Filed: Jun. 26, 2018

(86) PCT No.: PCT/KR2018/007230
§ 371 (c)(1),
(2) Date: May 13, 2020

(87) PCT Pub. No.: WO2019/098483
PCT Pub. Date: May 23, 2019

(65) Prior Publication Data

US 2020/0283877 A1 Sep. 10, 2020

(30) Foreign Application Priority Data

Nov. 17, 2017 (KR) ..... 10-2017-0154084

(51) Int. Cl.

| | |
|---|---|
| ***B32B 15/00*** | (2006.01) |
| ***C22C 38/44*** | (2006.01) |
| ***C21D 8/02*** | (2006.01) |
| ***C21D 9/46*** | (2006.01) |
| ***C22C 38/02*** | (2006.01) |
| ***C22C 38/04*** | (2006.01) |

(52) U.S. Cl.
CPC ..... *C22C 38/44* (2013.01); *C21D 8/0226* (2013.01); *C21D 9/46* (2013.01); *C22C 38/02* (2013.01); *C22C 38/04* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C22C 38/44; C22C 38/02; C22C 38/04; C22C 38/00; C22C 38/08; C22C 38/12; C22C 38/18; C22C 38/22; C22C 38/40; C21D 1/18; C21D 8/0226; C21D 9/46; C21D 2211/001; C21D 2211/002; C21D 2211/005; C21D 2211/008; C21D 1/22; C21D 8/02; C21D 8/0205; C21D 8/0263
USPC .... 148/335, 320, 333, 336; 420/8, 105, 108, 420/112, 119, 123
See application file for complete search history.

(56) References Cited

U.S. PATENT DOCUMENTS

2015/0147222 A1 5/2015 Miura et al.

FOREIGN PATENT DOCUMENTS

| | | | | | |
|---|---|---|---|---|---|
| EP | 1942203 | A1 | | 7/2008 | |
| EP | 2889391 | A1 | | 7/2015 | |
| EP | 2933347 | A1 | | 10/2015 | |
| EP | 3130687 | A1 | | 3/2017 | |
| EP | 3392361 | A1 | | 10/2018 | |
| JP | H06-179909 | A | | 6/1994 | |
| JP | H09-256039 | A | | 9/1997 | |
| JP | 2008-081776 | A | | 4/2008 | |
| JP | 2008081776 | A | * | 4/2008 | ..... C21D 8/02 |
| JP | 2011-219848 | A | | 11/2011 | |
| JP | 2011219848 | A | * | 11/2011 | ..... C22C 38/00 |
| JP | 2013-014811 | A | | 1/2013 | |
| JP | 2013-213273 | A | | 10/2013 | |
| JP | 2013-234381 | A | | 11/2013 | |
| JP | 2014-19936 | A | | 2/2014 | |
| JP | 2014-034708 | A | | 2/2014 | |
| JP | 2014-118579 | A | | 6/2014 | |
| JP | 2015-086403 | A | | 5/2015 | |
| KR | 10-0957929 | B1 | | 5/2010 | |
| KR | 100957929 | B1 | * | 5/2010 | ..... C21D 1/18 |
| KR | 10-2013-103422 | A | | 9/2013 | |
| KR | 10-2008-0038226 | A | | 5/2018 | |
| WO | 2015/064045 | A1 | | 7/2015 | |
| WO | 2017/104599 | A1 | | 6/2017 | |

OTHER PUBLICATIONS

TWI, "Austenite, Martensite, Bainite, Pearlite, and Ferrite Structures" 2021, TWI, p. 1-9 (Year: 2021).*
Britannica "Composition and Properties of Natural Gas" 2021, p. 1-4 (Year: 2021).*
International Search Report dated Oct. 12, 2018 issued in International Patent Application No. PCT/KR2018/007230 (with English translation).
Japanese Office Action dated Jul. 13, 2021 issued in Japanese Patent Application No. 2020-527087.
Extended European Search Report dated Jul. 27, 2020 issued in European Patent Application No. 18879047.1.

* cited by examiner

*Primary Examiner* — Seth Dumbris
(74) *Attorney, Agent, or Firm* — Morgan, Lewis & Bockius LLP

(57) ABSTRACT

Provided are a low-temperature steel plate having excellent impact toughness, and a method for manufacturing same, the low-temperature steel plate comprising, in wt %, 0.02-0.08% C, 6.0-7.5% Ni, 0.5-0.9% Mn, 0.03-0.15% Si, 0.02-0.3% Mo, and 0.1-0.3% Cr, and 50 ppm or less of P, 10 ppm or less of S, and the remainder in Fe and various unavoidable impurities, and the microstructure at ¼t (t: thickness of the steel plate) location of the steel plate comprising, in % surface area, 10-35% tempered bainite, 3-15% residual austenite, and the remainder in tempered martensite, and having granularity of 10 μm or less of high angle grain boundaries at 15° or greater as measured by Electron Backscatter Diffraction (EBSD).

4 Claims, No Drawings

LOW-TEMPERATURE STEEL PLATE HAVING EXCELLENT IMPACT TOUGHNESS, AND METHOD FOR MANUFACTURING SAME

CROSS-REFERENCE OF RELATED APPLICATIONS

This application is the U.S. National Phase under 35 U.S.C. § 371 of International Patent Application No. PCT/KR2018/007230, filed on Jun. 26, 2018, which in turn claims the benefit of Korean Application No. 10-2017-0154084, filed on Nov. 17, 2017, the entire disclosures of which applications are incorporated by reference herein.

TECHNICAL FIELD

The present disclosure relates to a steel plate for low-temperature tanks and a method of manufacturing the same, and more particularly, to a low-temperature steel plate containing nickel (Ni) having excellent impact toughness, using lower bainite, and a method of manufacturing the same.

BACKGROUND ART

Recently, interest in eco-friendly fuels has been amplified as global environmental regulations have been strengthened due to global warming and the like.

Liquefied Natural Gas (LNG), a representative eco-friendly fuel, is steadily increasing in consumption globally, due to cost reductions and increased efficiency through related technological developments. The consumption of LNG, which was only 23 million tons in six countries in 1980, has been doubling, about every 10 years.

As the LNG market expands and grows, existing facilities are being remodeled or expanded between LNG producing countries, and countries that are producing natural gas are also trying to construct production facilities to enter the LNG market.

LNG storage containers are classified by various criteria such as the purpose of the equipment (storage tanks, transport tanks), installation location, and internal and external tank types. Of these criteria, by the type of internal tank, for example, according to the material and shape, LNG storage containers are classified as 9% Ni steel internal tanks, membrane internal tanks, and concrete internal tanks. Recently, to improve the stability of LNG carriers, as the use of LNG storage containers of the type using 9% Ni steel material has been expanded from the field of on-shore storage tanks to the field of transportation tanks, global demand for 9% Ni steel has been increasing.

In general, in order for a material to be used in an LNG storage container, the material should have excellent impact toughness at cryogenic temperatures, and a relatively high strength level and ductility are required for stability of the structures. 9% Ni steel is generally produced through the process of Quenching-Tempering (QT) or Quenching-Lamellarizing-Tempering (QLT) after rolling. Through this process, a martensite matrix having fine crystal grains has a soft phase of retained austenite as a secondary phase, thereby exhibiting good impact toughness at cryogenic temperatures.

However, in the case of 9% Ni steel, as a relatively high Ni content is required to secure toughness, there is a problem in which the steel price rises according to the price fluctuation of the high cost element Ni, which may be a burden to a steel user.

In addition, during the quenching (Q) or lamellarizing (L) process, it is difficult to secure the shape of the thin plate due to the very fast cooling rate, and further, a long tempering process to remove residual stress is required, together with securing retained austenite, causing a problem such as overloading of heat treatment of steel company/calibration facilities.

To prevent the occurrence of these problems, in the case of 9% Ni steel, Direct Quenching-Tempering (DQT) technology, in which a quenching process is omitted in a manufacturing process, has been developed. In this case, the manufacturing costs and heat treatment load could be reduced by omitting the reheating and quenching process.

However, compared to the general quenching process, since the quenching properties are increased due to the rapid cooling rate of the direct quenching (DQ) process, there is a problem in which the heat treatment time should be increased during a tempering process. In addition, to refine the grain size, as the cryogenic rolling is performed during rolling, difficulty in securing the shape and cost increase due to reduction in rolling productivity occur.

On the other hand, the development and specification of 7% Ni steel having a lower Ni content, compared to the existing 9% Ni steel, was led by some steel companies, and to solve the problem such as a reduction in toughness due to Ni reduction, a QLT or Direct Quenching-Lamellarizing-Tempering (DQLT) process is used to include the lamellarizing (L) process, which has a significant effect on toughness improvement, so that 2% of Ni may be reduced, compared to the existing 9% Ni steel.

However, to reduce Ni of 2%, other alloying elements should be added to secure hardenability, and thus, the reduction of alloying costs is not high. In addition, some steelmakers introduced the DQLT process instead of the QLT process, and in this case, cryogenic rolling is applied in rolling before heat treatment to refine the grain size. Therefore, there is still a problem in which the rolling productivity is significantly reduced.

In addition, as the rapid cooling rate is applied during the Q (Quenching) or L (Lamellarizing) process, the tempering temperature should be increased or the tempering process for a long time should be applied. Further, as securing the shape of the thin material is difficult, there is a problem in which correcting several times is necessary.

DISCLOSURE

Technical Problem

An aspect of the present disclosure is to provide a low temperature steel plate having excellent impact toughness at low temperature.

Another aspect of the present disclosure is to provide a method of manufacturing a low temperature steel plate having excellent impact toughness at low temperature, the method including: slab reheating; air cooling after hot rolling; quenching heat treatment in an austenite single-phase region; quenching heat treatment in the two-phase region of ferrite and austenite; and air cooling after tempering.

Technical Solution

According to an aspect of the present disclosure, a low-temperature steel plate having excellent impact toughness, includes, in wt %, 0.02 to 0.08% of C, 6.0 to 7.5% of Ni, 0.5 to 0.9% of Mn, 0.03 to 0.15% of Si, 0.02 to 0.3% of Mo, and 0.1 to 0.3% of Cr, 50 ppm or less of P, 10 ppm or less of S, and as a remainder, Fe and other unavoidable impurities, a microstructure at a ¼t (t: a thickness of a steel plate) region of the steel plate including, in area %, 10 to 35% of tempered bainite, 3 to 15% of retained austenite, and a remainder of tempered martensite, and having a grain size of 10 μm or less at a high boundary angle of 15° or greater as measured by EBSD.

In the steel plate, a retained austenite fraction at −196° C. may be 3% by area or more.

The steel plate may be the low-temperature steel plate produced by a method including: slab reheating; air cooling after hot rolling; quenching heat treatment in an austenite single-phase region; quenching heat treatment in a two-phase region of ferrite and austenite; and air cooling after tempering, the microstructure of the steel plate after the quenching heat treatment in the two-phase region of ferrite and austenite and before tempering including, in area %, 10% or more of lower bainite, less than 5% of upper bainite, and a remainder of martensite.

In the steel plate, a fraction of the lower bainite may be 10% to 30% by area.

The steel plate may have a yield strength of 585 MPa or more.

The steel plate may have an impact transition temperature of −196° C. or less.

The steel plate may have a thickness of 5 mm to 50 mm. According to another aspect of the present disclosure, there is provided a low-temperature steel plate having excellent impact toughness, produced by a method including: slab reheating; air cooling after hot rolling; quenching heat treatment in the austenite single-phase region; quenching heat treatment in the two-phase region of ferrite and austenite; and air cooling after tempering, the low-temperature steel plate including, in wt %, 0.02 to 0.08% of C, 6.0 to 7.5% of Ni, 0.5 to 0.9% of Mn, 0.03 to 0.15% of Si, 0.02 to 0.3% of Mo, and 0.1 to 0.3% of Cr, 50 ppm or less of P, 10 ppm or less of S, and as a remainder, Fe and other unavoidable impurities, wherein a microstructure of a steel plate after the quenching heat treatment in the two-phase region of ferrite and austenite and before the tempering includes, in area %, 10% or more of lower bainite, less than 5% of upper bainite, and remaining martensite, and a microstructure at a ¼t (t: a thickness of the steel plate) region of the steel plate after the tempering includes, in area %, 10 to 35% of tempered bainite, 3 to 15% of retained austenite, and a remainder of tempered martensite, and has a grain size of 10 μm or less at a high boundary angle of 15° or greater as measured by EBSD.

According to another aspect of the present disclosure, a method of manufacturing a low-temperature steel plate having excellent impact toughness, includes, reheating, a steel slab including, in weight %, 0.02 to 0.08% of C, 6.0 to 7.5% of Ni, 0.5 to 0.9% of Mn, 0.03 to 0.15% of Si, 0.02 to 0.3% of Mo, 0.1 to 0.3% of Cr, 50 ppm or less of P, 10 ppm or less of S, and as a remainder, Fe and other unavoidable impurities, to a temperature of 1200 to 1100° C.;

hot-rolling the reheated steel slab to obtain a steel plate, and then, air cooling the steel plate;

performing quenching heat treatment of reheating the steel plate to a temperature of 800 to 950° C. in an austenite single-phase region, and then, of water cooling the steel plate;

performing quenching heat treatment of reheating the steel plate, having been subjected to the quenching heat treatment in the austenite single-phase region, to a temperature range of 680 to 710° C. in the two-phase region of ferrite and austenite, and then, of water cooling the steel plate at a cooling rate of 10 to 40° C./sec.; and tempering the steel plate having been subjected to the quenching heat treatment in the two-phase region of ferrite and austenite to a temperature of 570 to 600° C., and then, air cooling the steel plate, wherein a microstructure of the steel plate before tempering after the quenching heat treatment in the two-phase region of ferrite and austenite includes, in area %, 10% or more of lower bainite, less than 5% of upper bainite, and a remainder of martensite.

The tempering may be performed for a time of 1.9 t+40 to 80 minutes, where t is a steel thickness (mm).

A fraction of the lower bainite of the steel plate may be 10% to 30% by area.

The steel thickness may be 5 mm to 50 mm.

Advantageous Effects

As set forth above, according to an exemplary embodiment, a low-temperature steel plate having excellent impact toughness at a low temperature may be produced by a method including: slab reheating; air cooling after hot rolling; quenching heat treatment in an austenite single-phase region; quenching heat treatment in a two-phase region of ferrite and austenite; and air cooling after tempering.

BEST MODE FOR INVENTION

An exemplary embodiment may be appropriately applied to a method of manufacturing a low-temperature steel plate produced by a method including: slab reheating; air cooling after hot rolling; quenching heat treatment in an austenite single-phase region; quenching heat treatment in a two-phase region of ferrite and austenite; and air cooling after tempering.

In detail, according to an exemplary embodiment of the present disclosure, the cooling rate during the quenching heat treatment in the two-phase region of ferrite and austenite (lamellarizing) may be controlled. Therefore, lower bainite may be partially formed, and formation of coarse upper bainite may be suppressed.

In a low-temperature steel plate for tank and a method of manufacturing the same according to an exemplary embodiment, as described above, sufficient retained austenite may be generated even with minimal tempering time by partially generating lower bainite and suppressing coarse upper bainite, thereby securing excellent impact toughness even at −196° C., exhibiting yield strength of 585 MPa or higher and impact transition temperature of −196° C. or lower.

Hereinafter, a low temperature steel plate having excellent impact toughness according to an exemplary embodiment of the present disclosure will be described.

A low-temperature steel plate having excellent impact toughness according to an exemplary embodiment of the present disclosure includes, in wt %, 0.02 to 0.08% of C, 6.0 to 7.5% of Ni, 0.5 to 0.9% of Mn, 0.03 to 0.15% of Si, 0.02 to 0.3% of Mo, and 0.1 to 0.3% of Cr, 50 ppm or less of P, 10 ppm or less of S, and as a remainder, Fe and other unavoidable impurities. A microstructure at a ¼t (t: a thickness of a steel plate) region of the steel plate includes, in area %, 10 to 35% of tempered bainite, 3 to 15% of retained austenite, and a remainder of tempered martensite, and has a grain size of 10 μm or less at a high boundary angle of 15° or greater as measured by EBSD.

C: 0.02 to 0.08% by weight (hereinafter also referred to as "%")

C promotes the formation of martensitic transformation and lowers the Ms temperature (martensitic transformation temperature) to refine the grain size, and C is an important element to stabilize retained austenite by diffusing to the grain boundary and upper boundary when tempered. Therefore, in detail, C may be added in an amount of 0.02% or more. However, as the C content increases, the toughness decreases, and thus, a problem of decreasing the transformation stability by increasing the size of the retained austenite occurs. Therefore, the upper limit of the content may be limited to 0.08%.

Ni: 6.0-7.5%

Ni is an element that plays the most important role in stabilizing the retained austenite by spreading to the grain boundary and upper boundary when tempering, and by promoting the transformation of martensite/bainite to improve the strength of steel. Therefore, it may be preferable to add 6.0% or more of Ni to secure a fraction of martensite/austenite proposed in an exemplary embodiment. However, if Ni is added in excess of 7.5%, it is difficult to generate bainite due to relatively high hardenability, and long-term tempering is required due to an increase in strength. Therefore, it may be preferable to limit the Ni content to 6.0 to 7.5%.

Mn: 0.5 to 0.9%

Mn is an element that promotes C/Ni and martensite/bainite transformation to improve the strength of steel and stabilizes the retained austenite by diffusing to grain boundaries and phase boundaries when tempered, and thus, it may be preferable to add 0.5% or more of Mn. However, when the Mn content exceeds 0.9%, since the strength of the matrix tissue may increase and the toughness may decrease, it may be preferable to limit the manganese content to 0.5 to 0.9%.

Si: 0.03 to 0.15%

Si acts as a deoxidizer and also suppresses the formation of carbides during tempering, thereby improving the stability of retained austenite. Thus, it may be preferable to contain 0.03% or more of Si. However, the higher the Si content is, the more the strength is increased, and the lower the impact toughness is. Thus, the Si content is preferably limited to 0.03 to 0.15%.

Mo: 0.02 to 0.3%

Mo is a hardenability element that promotes the formation of martensite/bainite upon cooling. When Mo is added in an amount of 0.02% or more, Mo may actually improve the hardenability. However, when Mo is added in excess of 0.3%, the hardenability rises excessively, which may lead to a decrease in toughness due to non-formation of bainite and an increase in strength. Therefore, it may be preferable to limit the Mo content to 0.02 to 0.3%.

Cr: 0.1 to 0.3%,

Cr is a hardenability element that promotes the formation of martensite/bainite upon cooling, and needs to be added in an amount of 0.1% or more to help secure strength through solid solution strengthening. However, when Cr is added in excess of 0.3%, the hardenability increases excessively, which may lead to a decrease in toughness due to non-formation of bainite and an increase in strength, and the precipitation of Cr carbide may cause a decrease in toughness. Thus, it may be preferable to limit the Mo content to 0.1 to 0.3%.

P: 50 ppm or less, and S: 10 ppm or less

P and S are elements that cause brittleness at a grain boundary or forma coarse inclusion causing brittleness. Thus, a problem of deteriorating impact toughness may occur at the time of performing tempering. In the present disclosure, therefore, it may be preferable to limit P to 50 ppm or less and S to 10 ppm or less.

The remaining component in the exemplary embodiment is iron (Fe). However, in the ordinary steel manufacturing process, unintended impurities from raw materials or the surrounding environment may inevitably be mixed, and therefore, may not be excluded. These impurities are known to anyone skilled in the ordinary steel manufacturing process, and thus, are not specifically mentioned in this specification.

According to an exemplary embodiment of the present disclosure, a low-temperature steel plate having excellent impact toughness has a microstructure at a ¼t (t: a thickness of a steel plate) region of the steel plate, the microstructure including, in area %, 10 to 35% of tempered bainite, 3 to 15% of retained austenite and a remainder of tempered martensite, and having a grain size of 10 μm or less at high boundary angle of 15° or greater as measured by EBSD.

If the retained austenite fraction is less than 3%, impact toughness may be deteriorated, and if the grain size of the high boundary angle of 15 degrees or more measured by the EBSD method exceeds 10 μm (micrometer), the effective grain size decreases, and thus, impact toughness may deteriorate.

The steel plate may have a retained austenite fraction of 3% or more in area % at −196° C.

The steel plate is a low-temperature steel plate produced by a method including: slab reheating; air cooling after hot rolling; quenching heat treatment in an austenite single-phase region; quenching heat treatment in a two-phase region of ferrite and austenite; and air cooling after tempering. The microstructure of the steel plate after the quenching heat treatment in the two-phase region of ferrite and austenite and before tempering includes, in area %, 10% or more of lower bainite, less than 5% of upper bainite, and the remaining martensite.

If the microstructure of the steel plate after quenching heat treatment in the two-phase region of ferrite and austenite and before tempering includes less than 10 area % of lower bainite, retained austenite is generated in less than 3%, so that impact toughness may decrease, it may be preferable to include 10% or more of lower bainite. The upper limit of the fraction of the lower bainite may be limited to 30%.

If the microstructure of the steel plate before tempering treatment after quenching heat treatment in the two-phase region of ferrite and austenite includes more than 5 area % of upper bainite, since the impact toughness may be lowered due to coarsening of the grain size, the upper bainite may be preferably included in an amount of less than 5%.

The steel plate of this embodiment may have a yield strength of 585 MPa or more.

The steel plate of this embodiment may have an impact transition temperature of −196° C. or less.

The steel plate of this embodiment may have a thickness of 5 to 50 mm.

Hereinafter, a method of manufacturing a low-temperature steel plate having excellent impact toughness according to another exemplary embodiment of the present disclosure will be described.

According to another exemplary embodiment of the present disclosure, a method of manufacturing a low-temperature steel plate having excellent impact toughness includes, reheating, a steel slab including, in weight %, 0.02 to 0.08% of C, 6.0 to 7.5% of Ni, 0.5 to 0.9% of Mn, 0.03 to 0.15% of Si, 0.02 to 0.3% of Mo, 0.1 to 0.3% of Cr, 50 ppm or less of P, 10 ppm or less of S, and as a remainder, Fe and other unavoidable impurities, to a temperature of 1200 to 1100° C.;

hot-rolling the reheated steel slab as described above to obtain a steel plate, and then, air cooling the steel plate;

performing quenching heat treatment of reheating the steel plate to a temperature of 800 to 950° C. in an austenite single-phase region, and then, of water cooling the steel plate;

performing quenching heat treatment of reheating the steel plate, having been subjected to the quenching heat treatment in the austenite single-phase region, to a temperature range of 680 to 710° C. in the two-phase region of ferrite and austenite, and then, of water cooling the steel plate at a cooling rate of 10 to 40° C./sec.; and tempering the steel plate, having been subjected to the quenching heat treatment in the two-phase region of ferrite and austenite, to a temperature of 570 to 600° C., and then, air cooling the steel plate, wherein a microstructure of the steel plate before tempering after the quenching heat treatment in the two-phase region of ferrite and austenite includes, in area %, 10% or more of lower bainite, less than 5% of upper bainite, and a remainder of martensite.

Steel Slab Reheating, Hot Rolling and Air Cooling

The steel slab formed as described above is reheated.

When reheating the steel slab, it may be preferable to set the heating temperature to 1100 to 1200° C., which is for removing the casting structure and homogenizing the components.

After heating the steel slab as described above to adjust the shape thereof, hot rolling (rough rolling and finishing rolling) is performed to obtain a steel plate. An effect of reducing the grain size may also be obtained through the recrystallization of coarse austenite along with the destruction of the casting structure such as dendrites formed during casting by hot rolling. In this case, the hot rolling is not particularly limited, and may be performed by a general hot rolling process. For example, the hot rolling may be performed to control the steel thickness through a general rolling process.

After the end of hot rolling, the steel plate is air-cooled to room temperature.

Quenching Heat Treatment in an Austenite Single-Phase Region

The steel plate air-cooled as described is heated to the austenite single-phase region, and is then quenched by water cooling.

Performing this quenching is to obtain austenite grain size refinement by a heat treatment and a martensite/bainite structure having a fine packet during cooling.

To cause sufficient recrystallization in the austenite single-phase region and to maintain a fine grain size, it may be preferable to set the quenching heat treatment temperature to 800 to 950° C.

Quenching Heat Treatment in a Two-Phase Region of Ferrite and Austenite

The steel plate, having been subjected to the quenching heat treatment in the austenite single-phase region as described above, is reheated into austenite and ferrite two phase regions, followed by heat treatment and quenching.

Performing this quenching is to further refine the refined structure during the existing heat treatment in the two-phase region of ferrite and austenite to obtain a grain size of 10 μm (micrometer) or less with a high boundary angle of 15 degrees or more as measured by EBSD, and further, is to obtain a microstructure including 10% or more of lower bainite and less than 5% of upper bainite, in addition to martensite, by limiting a cooling rate during quenching.

When 10% or more of lower bainite is produced during quenching, nucleation of retained austenite during tempering is promoted due to carbide contained in the lower bainite structure, to reduce the tempering time, thereby promoting generation of stable retained austenite to improve impact toughness at cryogenic temperatures.

If a cooling rate is very fast during quenching, the martensitic single-phase structure is formed instead of the formation of lower bainite, such that it is not expected to improve the impact toughness using the lower bainite.

If a cooling rate is slow during quenching, coarse upper bainite is generated in a large amount to increase the grain size, and thus, there is a problem in which cryogenic impact toughness is lowered. Therefore, the generation of upper bainite should be controlled to be less than 5% in the amount by controlling the cooling rate.

To refine the austenite grain size and obtain a grain size of 10 μm (micrometer) or less with a high boundary angle of 15 degrees or more measured by EBSD, it may be preferable to set a quenching heat treatment temperature to 680 to 710° C. in a two-phase region of ferrite and austenite.

In addition, to promote the formation of lower bainite and suppress the formation of upper bainite during quenching, it may be preferable to set the cooling rate during quenching to 10 to 40° C./sec.

If the cooling rate exceeds 40° C./sec, martensite is excessively generated, which takes a lot of time to secure retained austenite when tempered, thereby deteriorating toughness, and if less than 10° C./sec, since the coarse upper bainite is generated, toughness is reduced.

The microstructure of the steel plate after the quenching heat treatment in the two-phase region of ferrite and austenite includes 10% or more of lower bainite, less than 5% of upper bainite and the remaining martensite.

Tempering and Air Cooling

The steel plate having been subjected to the quenching heat treatment in the two-phase region of ferrite and austenite as described above is reheated to a temperature of 570 to 600° C. for tempering, and then is air-cooled.

The tempering may be carried out for a time of 1.9t (t is a steel thickness, mm)+40-80 minutes.

In the case of the cryogenic steel plate according to an exemplary embodiment of the present disclosure, impact toughness may be improved by producing 3% or more of austenite that is stable even at −196° C., in addition to improving impact toughness through softening of the matrix when tempering. Since a lot of residual stress due to the rapid cooling rate during quenching remains inside the structure, a tempering temperature of 570° C. or higher may be preferable to remove the residual stress and soften the matrix.

If tempering to a temperature exceeding 600° C., the stability of austenite formed in the microstructure decreases, and as a result, the austenite may easily transform into martensite at cryogenic temperatures, and impact toughness may deteriorate. Therefore, it may be preferable to set the tempering temperature to 570 to 600° C. In addition, it may be preferable to carry out tempering for a time of 1.9 t (t is a steel thickness, mm)+40 to 80 minutes to improve productivity.

After the tempering operation, the retained austenite fraction at −196° C. is 3% or more, and the grain size of the high boundary angle of 15 degrees or more measured by the EBSD method is 10 μm (micrometer) or less.

According to a method of manufacturing a low-temperature steel plate having excellent impact toughness according to another exemplary embodiment of the present disclosure, after quenching heat treatment in the two-phase region of ferrite and austenite, the fraction of the lower bainite is 10% or more and the fraction of upper bainite is less than 5%. In addition, after tempering, the retained austenite fraction at −196° C. is 3% or more, and the grain size of the high boundary angle of 15 degrees or more measured by the EBSD method is 10 micrometers or less. As a result, a low-temperature steel plate for a tank in which the yield strength is 585 MPa or more, and the impact transition temperature is −196° C. or lower may be secured.

MODE FOR INVENTION

Hereinafter, an exemplary embodiment of the present disclosure will be described in more detail. However, it is necessary to note that the following examples are only for describing the present disclosure byway of example and not for limiting the scope of the present disclosure. This is because the scope of the present disclosure is determined by the items described in the claims and the items reasonably inferred therefrom.

After reheating the 250 mm thick steel slab having the composition of Table 1 below to a temperature of 1150° C., rough rolling and finishing rolling were performed to prepare a steel plate having a thickness of 25 mm.

The steel plate was reheated to a temperature of 820° C., and was then water-cooled to be subjected to quenching heat treatment in the austenite single-phase region.

The steel plate having been subjected to the quenching heat treatment in an austenite single-phase region as described above was reheated to a temperature range of ferrite and austenite at 710° C., and then, was water cooled at the cooling rate in Table 2 below to be subjected to quenching heat treatment in a two-phase region of ferrite and austenite.

The steel plate having been subjected to the quenching heat treatment in the two-phase region of ferrite and austenite as described above was reheated to a tempering temperature in Table 2 below, and then, was tempered for 1.9 t (t: a steel thickness, mm)+60 minutes, and then followed by air cooling.

With respect to the steel plate produced as described above, the fraction (area %) of lower bainite and upper bainite of the steel plate after the quenching heat treatment in the two-phase region of ferrite and austenite, the retained austenite fraction (area %) at −196° C. of the steel plate after tempering, yield strength (MPa), average CVN Energy @−196° C. (J), and impact transition temperature (° C.) were measured, and the results are illustrated in Table 2 below.

TABLE 1

| Steel type | Chemical composition (weight %) | | | | | | | |
|---|---|---|---|---|---|---|---|---|
| | C | Ni | Mn | Si | P | S | Mo | Cr |
| Inventive Steel 1 | 0.04 | 6.82 | 0.55 | 0.06 | 0.0024 | 0.0006 | 0.23 | 0.22 |
| Inventive Steel 2 | 0.03 | 7.23 | 0.67 | 0.08 | 0.0037 | 0.0005 | 0.07 | 0.21 |
| Inventive Steel 3 | 0.05 | 7.02 | 0.71 | 0.11 | 0.0029 | 0.0004 | 0.15 | 0.19 |
| Inventive Steel 4 | 0.07 | 6.29 | 0.85 | 0.13 | 0.0037 | 0.0006 | 0.28 | 0.23 |
| Comparative Steel 1 | 0.12 | 7.02 | 0.65 | 0.09 | 0.0024 | 0.0007 | 0.19 | 0.23 |
| Comparative Steel 2 | 0.04 | 5.75 | 0.59 | 0.07 | 0.0037 | 0.0005 | 0.18 | 0.25 |
| Comparative Steel 3 | 0.06 | 7.22 | 1.34 | 0.05 | 0.0028 | 0.0005 | 0.23 | 0.16 |
| Comparative Steel 4 | 0.05 | 7.34 | 0.72 | 0.45 | 0.0024 | 0.0007 | 0.22 | 0.14 |
| Comparative Steel 5 | 0.03 | 6.45 | 0.89 | 0.09 | 0.0037 | 0.0005 | 0.48 | 0.23 |
| Comparative Steel 6 | 0.05 | 6.79 | 0.71 | 0.11 | 0.0024 | 0.0007 | 0.11 | 0.53 |
| Comparative Steel 7 | 0.06 | 7.11 | 0.54 | 0.13 | 0.0079 | 0.0023 | 0.19 | 0.15 |

TABLE 2

| Example No. | Steel type | Tempering Temperature (° C.) | Quenching heat treatment in a two-phase region of ferrite and austenite cooling rate (° C./sec) | Lower bainite fraction (%) | Upper bainite fraction (%) | Yield strength (MPa) | Retained Austenite fraction @−196° C. (%) | EBSD measurement grain size (μm) | Average CVN Energy @ −196° C. (J) | Impact transition temperature (° C.) |
|---|---|---|---|---|---|---|---|---|---|---|
| Inventive Example 1 | Inventive Steel 1 | 579 | 17.6 | 22.3 | 2.7 | 635 | 5.9 | 7.5 | 203 | −196° C. or lower |
| Inventive Example 2 | Inventive Steel 2 | 585 | 13.5 | 29.1 | 3.1 | 649 | 6.3 | 6.8 | 215 | −196° C. or lower |
| Inventive Example 3 | Inventive Steel 3 | 579 | 25.1 | 19.3 | 2.6 | 665 | 4.9 | 6.7 | 198 | −196° C. or lower |
| Inventive Example 4 | Inventive Steel 4 | 587 | 37.9 | 13.5 | 0 | 655 | 7.3 | 7.2 | 216 | −196° C. or lower |
| Comparative Example 1 | Inventive Steel 2 | 591 | 6.2 | 11.1 | 23.5 | 615 | 2.8 | 15.6 | 68 | −164 |
| Comparative Example 2 | Inventive Steel 3 | 568 | 59.3 | 0 | 0 | 701 | 1.6 | 7.6 | 88 | −181 |
| Comparative Example 3 | Inventive Steel 4 | 615 | 19.8 | 16.8 | 3.6 | 581 | 0.8 | 8.2 | 97 | −190 |
| Comparative Example 4 | Comparative Steel 1 | 588 | 18.6 | 0 | 0 | 721 | 1.3 | 6.8 | 98 | −191 |

TABLE 2-continued

| Example No. | Steel type | Tempering Temperature (° C.) | Quenching heat treatment in a two-phase region of ferrite and austenite cooling rate (° C./sec) | Lower bainite fraction (%) | Upper bainite fraction (%) | Yield strength (MPa) | Retained Austenite fraction @−196° C. (%) | EBSD measurement grain size (μm) | Average CVN Energy @ −196° C. (J) | Impact transition temperature (° C.) |
|---|---|---|---|---|---|---|---|---|---|---|
| Comparative Example 5 | Comparative Steel 2 | 579 | 15.7 | 12.6 | 28.7 | 577 | 0.7 | 14.9 | 49 | −153 |
| Comparative Example 6 | Comparative Steel 3 | 591 | 31.1 | 0 | 0 | 698 | 2.5 | 7.6 | 73 | −169 |
| Comparative Example 7 | Comparative Steel 4 | 568 | 17.6 | 18.9 | 3.6 | 638 | 2.1 | 8.3 | 64 | −171 |
| Comparative Example 8 | Comparative Steel 5 | 574 | 24.6 | 0 | 0 | 716 | 1.3 | 6.8 | 54 | −162 |
| Comparative Example 9 | Comparative Steel 6 | 586 | 31.9 | 0 | 0 | 702 | 1.4 | 7.2 | 67 | −159 |
| Comparative Example 10 | Comparative Steel 7 | 573 | 17.2 | 20.2 | 2.7 | 667 | 4.5 | 7.9 | 21 | −141 |

As illustrated in Table 1 and Table 2, in the case of Comparative Example 1, the coarse upper bainite was generated 23.5% in large quantity according to the quenching cooling rate slower than 10-40° C./sec when carrying out the quenching heat treatment in the two-phase region of ferrite and austenite proposed in an exemplary embodiment of the present disclosure. Therefore, it can be seen that this resulted in an impact transition temperature of −196° C. or higher because the grain size of the high boundary angle of 15 degrees or more measured by EBSD was 10 μm (micrometer) or more, and the retained austenite stabilized at −196° C. after tempering was less than 3%.

In the case of Comparative Example 2, after the quenching heat treatment in the two-phase region of ferrite and austenite proposed in an exemplary embodiment of the present disclosure, the quenching cooling rate was faster than 10-40° C./sec, so that the lower bainite was not generated, and thus, the retained austenite was not sufficiently produced at the time of tempering. As a result, it can be seen that since the retained austenite stabilized at −196° C. after tempering is less than 3%, an impact transition temperature is −196° C. or higher.

In the case of Comparative Example 3, the heat treatment was performed at a temperature exceeding the tempering temperature range of 570 to 600° C. suggested in an exemplary embodiment of the present disclosure, and as a result, the yield strength was excessively decreased, so that the yield strength was 585 Mpa or less, and retained austenite was not sufficiently stabilized during tempering and was coarsely generated. Therefore, it can be seen that retained austenite produced at −196° C. after tempering is less than 3% and impact transition temperature is −196° C. or higher.

In the case of Comparative Example 4, since the C content has a value higher than the upper limit of C suggested in the present disclosure, the lower bainite structure was not formed due to excessive hardenability, and as a result, the retained austenite was not sufficiently stabilized and was coarse when tempered. Therefore, it can be seen that the retained austenite produced at −196° C. after tempering is less than 3%, and the impact transition temperature is −196° C. or higher.

In the case of Comparative Example 5, since the Ni content has a value lower than the lower limit of the Ni content suggested in the present disclosure, a large amount of coarse upper bainite was generated in 10% or more due to lack of hardenability. Therefore, it can be seen that the impact transition temperature is −196° C. or higher because the grain size of the high boundary angle of 15 degrees or higher measured by EBSD is 10 μm (micrometer) or higher and the retained austenite stabilized at −196° C. after tempering is less than 3%. In addition, it can be seen that the yield strength is 585 Mpa or less as the yield strength is excessively decreased after tempering due to the lack of hardenability.

In the case of Comparative Example 6, since the content of Mn has a value higher than the upper limit of the Mn content suggested in the present disclosure, the lower bainite structure was not generated due to excessive hardenability, and thus, the retained austenite was not sufficiently stabilized when tempered and was produced coarsely. Therefore, it can be seen that the retained austenite produced at −196° C. after tempering is less than 3%, and the impact transition temperature is −196° C. or higher.

In the case of Comparative Example 7, since the Si content has a value higher than the upper limit of the Si content suggested in the present disclosure, the austenite stabilization effect of Si is excessively generated, and thus, the retained austenite is not sufficiently stabilized and is coarse. Therefore, it can be seen that the retained austenite produced at −196° C. after tempering is less than 3%, and the impact transition temperature is −196° C. or higher.

In the case of Comparative Examples 8 and 9, the contents of Mo and Cr had a value higher than the upper limits of the Mo and Cr contents suggested in the present disclosure, respectively, so that the lower bainite structure was not formed due to excessive hardenability, and thus, the retained austenite was not sufficiently stabilized and was generated coarsely. Therefore, it can be seen that the retained austenite produced at −196° C. after tempering is less than 3% and the impact transition temperature is −196° C. or higher.

In the case of Comparative Example 10, the P and S contents have a value higher than the upper limits of the P and S contents suggested in the present disclosure, respectively. Thus, it can be seen that the impact transition temperature is −196° C. or higher, despite satisfying all other microstructural requirements, due to grain boundary segregation and MnS inclusion generation after tempering.

On the other hand, in the case of Inventive Examples 1 to 4 satisfying the steel composition and manufacturing conditions suggested in an exemplary embodiment of the present disclosure, it can be seen that not only the fraction of the lower bainite after quenching heat treatment in the two-phase region of ferrite and austenite is 10% or more but also the fraction of the upper bainite is less than 5%, and the retained austenite fraction at −196° C. after tempering is 3% or more, the grain size of the high boundary angle of 15 degrees or more measured by the EBSD method is 10 μm (micrometer) or less, the yield strength is 585 MPa or more, and the impact transition temperature is −196° C. or lower.

The invention claimed is:

1. A steel plate, comprising:

in wt %, 0.02 to 0.08% of C, 6.0 to 7.5% of Ni, 0.5 to 0.9% of Mn, 0.03 to 0.15% of Si, 0.02 to 0.3% of Mo, and 0.1 to 0.3% of Cr, 50 ppm or less of P, 10 ppm or less of S, and as a remainder, Fe and other unavoidable impurities, a microstructure at a ¼t (t: a thickness of a steel plate) region of the steel plate comprising, in area %, 10 to 35% of sum of a tempered lower bainite and tempered upper bainite, 3 to 15% of retained austenite, and a remainder of tempered martensite, and having a grain size of 10 μm or less at a high boundary angle of 15° or greater as measured by Electron Backscatter Diffraction (EBSD), wherein in the steel plate, a retained austenite fraction at −196° C. is 3 to 15% by area.

2. The steel plate of claim 1, wherein the steel plate has a yield strength of 585 MPa or more.

3. The steel plate of claim 1, wherein the steel plate has an impact transition temperature of −196° C. or less.

4. The steel plate of claim 1, wherein the steel plate has a thickness of 5 mm to 50 mm.

* * * * *